United States Patent [19]

Cecchetti

[11] 4,042,239

[45] Aug. 16, 1977

[54] GAME PLAYING STRUCTURE PARTICULARLY SOCCER GAME STRUCTURE

[76] Inventor: Claudio Cecchetti, Via Verdi, 54, Cernusco sul Naviglio (Milan), Italy

[21] Appl. No.: 706,856

[22] Filed: July 19, 1976

[30] Foreign Application Priority Data

July 21, 1975 Italy ..... 25607/75

[51] Int. Cl.[2] ..... A63F 7/10

[52] U.S. Cl. ..... 273/85 F; 273/85 D; 273/85 E; 273/129 HA; 273/129 HB

[58] Field of Search ..... 273/85 D, 85 C, 85 B, 273/85 E, 85 F, 129 GA, 129 GB, 129 HA, 129 HB

[56] References Cited

U.S. PATENT DOCUMENTS

| | | | |
|---|---|---|---|
| 3,647,212 | 3/1972 | Barlow et al. | 273/85 B |
| 3,856,303 | 12/1974 | Payne, Jr. et al. | 273/85 B |

FOREIGN PATENT DOCUMENTS

| | | | |
|---|---|---|---|
| 140,045 | 1/1951 | Australia | 273/85 F |
| 1,170,643 | 9/1958 | France | 273/85 F |
| 1,171,613 | 10/1958 | France | 273/85 F |
| 716,733 | 12/1941 | Germany | 273/85 F |
| 823,331 | 11/1959 | United Kingdom | 273/85 F |
| 1,334,133 | 10/1973 | United Kingdom | 273/85 B |

*Primary Examiner*—Paul E. Shapiro
*Attorney, Agent, or Firm*—Guido Modiano; Albert Josif

[57] ABSTRACT

A game playing structure, particularly a soccer game where the ball, disposed on a playing field at a given distance from a player figure, is thrown away by the movement of a throwing portion of the player figure, the movement of this part being obtained through mechanical means operated by a person taking part in the game. The throwing portion of the player figure may be a leg swingable under the action of a biasing spring. The figure is movable parallel to the surface of the playing field through the mechanical means. An obstacle is arranged on the surface of the playing field in the path of motion of the throwing portion, which obstacle during the figure movement initially holds back the throwing portion and rotates the same against the biasing spring and then releases it as the figure moves further, thus throwing the ball away on the playing field.

19 Claims, 14 Drawing Figures

GAME PLAYING STRUCTURE PARTICULARLY SOCCER GAME STRUCTURE

BACKGROUND OF THE INVENTION

This invention relates to a game playing structure, and more particularly to a soccer game structure, in which game the ball or similar, held to the surface of a playing field at a given distance from a soccer player figure, is thrown away through the player movement, a movement by the adult or child taking part in the game being transferred to the soccer player figure by mechanical means.

A large number of games of this type are known wherein the means for moving the player figures, and accordingly the ball, is comparatively complicated. Thus, for instance, the German Pat. No. 1,012,853 discloses a soccer or football match game in which the player figures are affixed to pivotable shafts about vertical axes, through the hollow shaft of each figure a rod being led which is arranged to shift longitudinally therewithin, said rod actuating a movable leg of the soccer player figure. The actuating means for that figure is complicated and liable to fail in operation. Furthermore, the acutating means projects above the playing field surface. This is disadvantageous not only from an aesthetic point of view but also because it departs from the full-size game appearance, thereby the suggestiveness of the game is considerably diminished.

Also known are a plurality of games wherein the movement of the player figures is effected by means of electromagnets. Such magnetic devices are extremely costly, whereby the game sets cannot be manufactured at a low cost that would make their retail price attractive.

SUMMARY OF THE INVENTION

This invention aims at providing a game set of the type mentioned above, wherein a mechanical movement of the player figure takes place in order to move the ball or similar, such a movement being obtained through the use of simple means of low cost but of robust construction. Such means should not be visible to an observer, or at least be so arranged as to induce in the persons involved in the game playing the impression of an actual football match or the like. Therefore, a ball, or similar, throwing portion, e. g., the leg of a player figure, must move as far as possible like its full-size counterpart. Thus, a soccer game set is contemplated, of preference, wherein for each competitor a corresponding set of player figures or team is provided in the field. The game set may also be configurated such as to simulate other full-size games, such as hockey, wherein the movement of a ball or puck (hard rubber disc) is effected through a pusher actuated by the player figure.

To achieve this object, the invention proposes first of all that to the player figure a throwing portion, specifically in the form of a leg, be connected such as to swing against a biasing spring, that the figure be movable across the playing field surface by mechanical means, that an obstacle be disposed on the playing field surface such as to lay in the path of motion of the throwing portion, which obstacle, as the figure moves, initially holds back the throwing portion and rotates it against the spring action, and then releases it as the figure carries further its movement, and that the support for the ball or similar be provided in the figure direction of motion at the area of the throwing portion during the return stroke following its release due to the spring action. In this manner, the ball is moved in a fashion that is quite faithful to the full-size practice, since the player figure moves in the throwing direction, the throwing portion (a leg in the case of a soccer player) is caused to rotate backward initially with a relatively slow motion and then abruptly swung forward at high speed in order to kick the ball. This reproduction of the original is substantially faithful, especially when the game is played by children, when it enhances the suggestiveness of the game itself. It should be added to the above that the means for transferring the movement from a knob, or the like, to the player figure may be very simply configurated and located below the playing field, for instance in the form of a rod movable against a biasing spring. The obstacle also may be produced with simple means, e.g., as a plastic part either glued to the same upper surface, or otherwise attached to, or formed integral with, the game surface.

The ball, or similar, support may be implemented as desired. According to a preferred embodiment of the invention, in the playing field, or underneath it, a permanent magnet is installed to this aim, the ball or its equivalent being provided with an iron mass. The above reflects techniques which are known per se. However, in conjunction with the inventive arrangement, this has the advantage that the ball support is also concealed from the persons taking part in the game, whereby the impression of a faithful replica of the real thing is further enhaced. The ball magnetic support may advantageously be implemented, according to the invention, such that the ball is made of some foamed plastics and consequently of very low weight, e.g., of Styropor (registered trademark) in which metal parts are inserted which are sensitive to a magnetic field, e.g., iron nails. Owing to the light weight of the ball, the latter may be sent by the player figure throwing portion to a considerable distance and at a correspondingly high speed. The nails, distributed over the ball surface, ensure that the ball is at all times attracted by the magnetic support. Furthermore, the nail heads, which heads are approximately flush with the ball surface, give the impression, in the otherwise white plastics of the ball, of being those black patches characterizing the full-size soccer balls presently in use.

In order to secure the player figure to the mechanical actuating means, an attaching structure may be advantageously provided comprising an intermediate connecting member effective to be fixedly attached with one end to the mechanical actuating means actuating rod, and provided with engagement means for its detachable engagement with correspondingly mating engagement means provided one leg of the player figure. In this manner, the player figure may be inserted and withdrawn at any time from the intermediate connecting member, which remains instead permanently affixed to the actuating rod to which it will be mounted at the moment of assembling the game set. The player figure insertion and withdrawal, operation is advantageously carried out on the same side of the playing plane, without requiring access to the parts arranged under that plane.

BRIEF DESCRIPTION OF THE DRAWINGS

Further features and advantages of the invention may be inferred from the accompanying claims as well as from the following description and accompanying drawings of an exemplary embodiment of the invention.

In the drawings.

DESCRIPTION OF THE PREFERRED EMBODIMENTS

Figure 2:
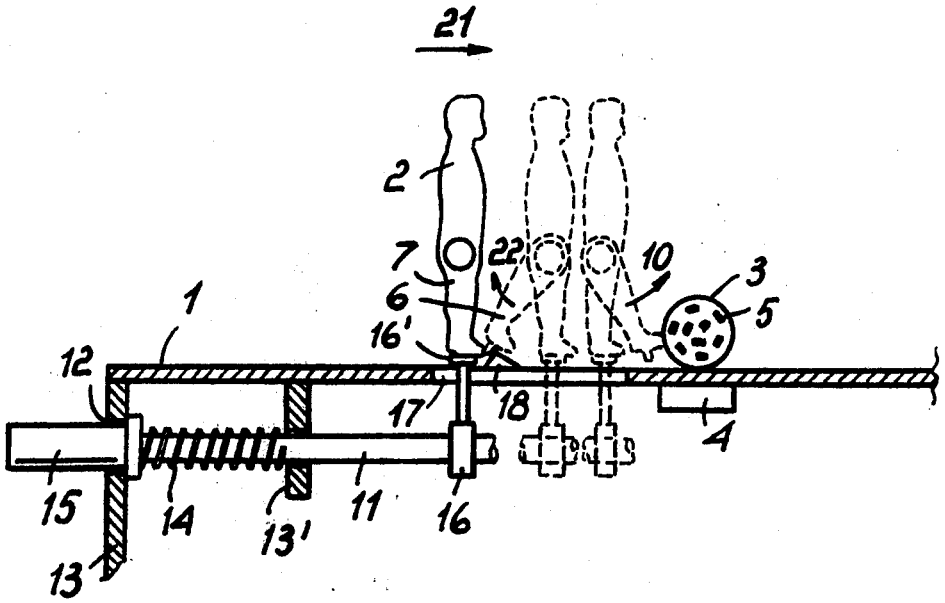
FIG. 2 is a sectional view taken along the line II—II in FIG. 1.

The inventive game playing structure, in the instant case a soccer game, comprises the playing surface, respectively the playing field 1, and a plurality of player figures 2, for each competitor, respectively team, there being provided a corresponding number of figures. At a corresponding distance in front of each player figure, a support is provided for the ball 3. In this embodiment of the invention, that support is comprised of a permanent magnet 4, located under the playing field 1, for example glued to it. The ball 3 is made of foamed plastic material, preferably Styropor, and incorporates ferromagnetic material parts. However, it is also possible to provide an alternative support for the ball in the form, for example, of a recess in the playing field. Instead of a ball, another part could be used similarly, depending on the game, such as the puck as used for ice hockey.

Figure 3:
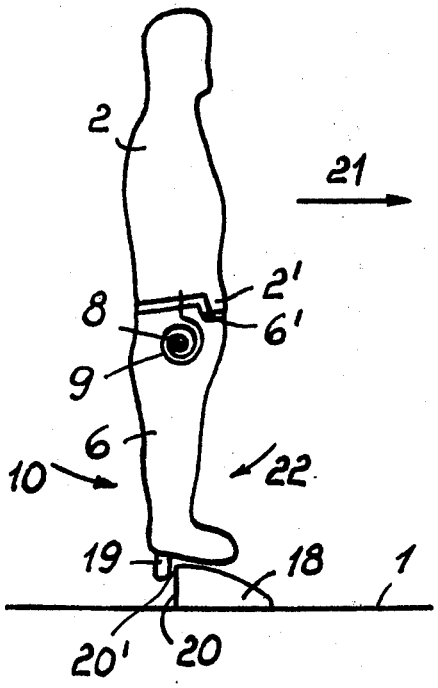
FIG. 3 is an enlarged scale view of the player figures as seen along the arrowhead III in FIG. 1.

The striking portion, respectively throwing, of the figure is, in the present instance, the movable leg 6 of the player FIG. 2, whereas the stationary supporting leg is denoted with the numeral 7. Should the game be a hockey set, then the striking portion would be configurated to correspond to a pusher or striker. The cited leg or striking portion 6 is journaled to the FIG. 2 (see particularly FIG. 3) through a horizontal axis 8. A spring 9 is connected on one side to the throwing portion 6 and on the other side to the FIG. 2 such that it tends to swing the throwing portion 6 in the direction of the arrow 10. The body 2 and the throwing portion 6 may be provided, to this end, with locking parts 2', 6', which are located one above the other under the action of the spring 9 and thus prevent the throwing portion 6 from being oscillated forward to an excessive extent by the spring. That position may correspond approximately to the stand-by position of the player figure preparatory to striking.

Figure 1:
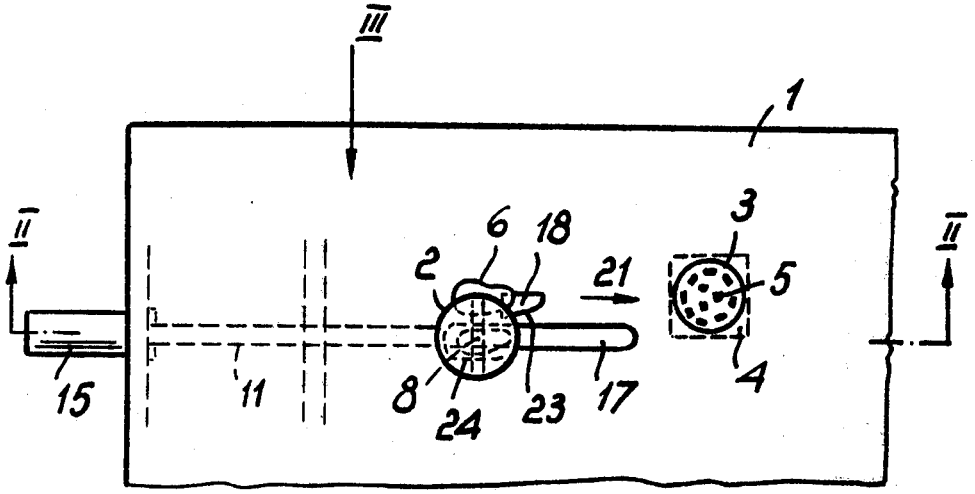
FIG. 1 is a top plan view of a part of soccer game set according to this invention.

The player figure is movable across the playing field and specifically, in the instant embodiment, by means of a rod 11, which is supported in guides 12 of the playing field frame 13, respectively of a strip 13', movably longitudinally against the action of a biasing spring 14. One end of the rod 11 carries a knob 15 to be operated by the person taking part in the game, whereas the other end of the rod is firmly connected to the supporting leg 7 through a part 16. The part 16, to this aim, goes through a slot guide 17 in the playing field. The supporting leg 7 may be provided at its lower portion with a sliding piece 16', which rests on the side edges of the slot guide 17 to guide the figure therein. In its stand-by position, the FIG. 2 is subjected to the action of the spring 14 at the end of the slot guide 17 opposite the support 4 for the ball (see the representation of FIG. 1, as well as the position in FIG. 2 shown in full lines).

On the playing field surface, there is disposed an obstacle 18. The latter is located, in the stand-by position near to the player figure, in front of the throwing portion 6. The throwing portion is formed with an abutment 19, which is of preference formed integrally with the leg 6.

The obstacle 18 is provided with a reaction surface 20 and a sliding surface 23. As the FIG. 2 is moved, respectively shifted, in the direction of motion 21, the abutment 19 comes to rest against the reaction surface 20 and the throwing portion 6 is moved in the direction of the arrow 22 against the spring 9 bias. As soon as the throwing portion 6 is swung backward through a given angle (see the representation shown in dotted lines in FIG. 2), the bottom part of the abutment 19 has been raised to the point that it slides over the upper side 20' of the supporting reaction surface and disengage from the obstacle, thereby the striking position, respectively throwing 6, swings abruptly forward, under the action of the spring 9 heavily preload in this position, and throws away the ball 3 (see the representation shown in dotted lines on the right of FIG. 2). Then the throwing portion 6 abutment slides onto a sliding surface 23 extending obliquely with respect to the direction of motion and the figure can shift slightly sideways into a cavity 24 of the slot guide 17, thereby the figure comes back to the initial or start position under the action of the spring 14. It should be understood that in a construction like in the aforesaid exemplary embodiment of the invention, the distance of the abutment 19 lower side from the rotation axis 8 as well as the distance of the side 20' from that same rotation axis are so selected that when the throwing part 6 has nearly completed its backward movement, said part is released and enabled to swing forward.

Figure 4:
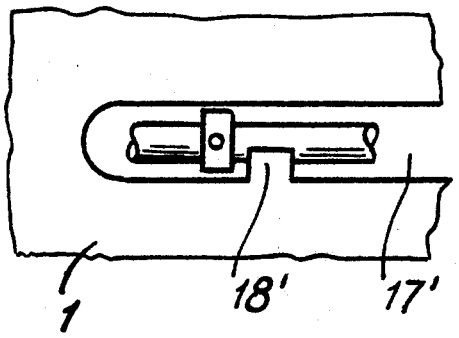
FIG. 4 is a fragmentary view from above of a further embodiment of the invention.

As shown in the embodiment of FIG. 4, the obstacle, denoted with the reference numeral 18', may be located on the side wall of the guide slot 17'. In this case, the projection 19 will be made correspondingly longer.

Figure 5:
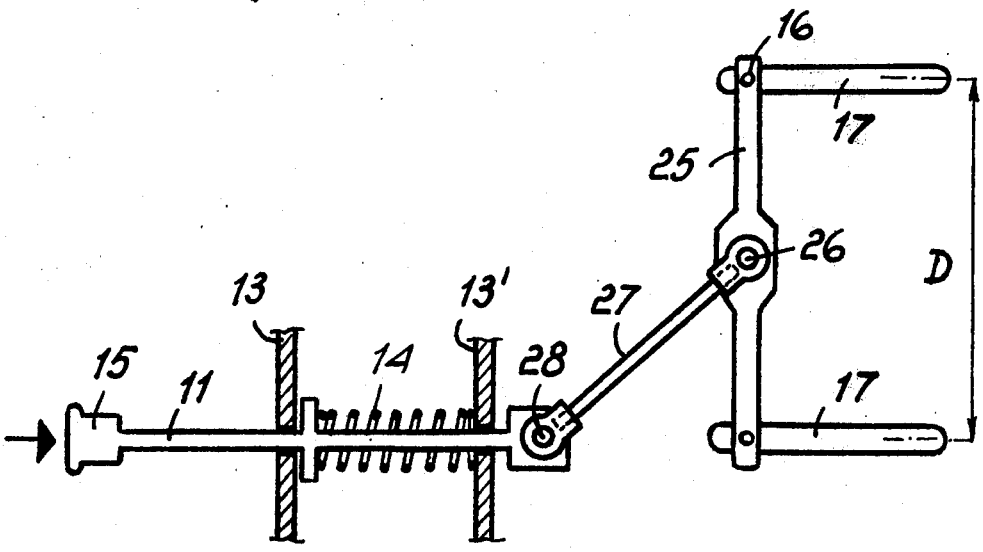
FIG. 5 shows a variation of the actuating means.

According to a variation of the invention, provision is made for actuating with a single control two or more player figures. In the latter case, it is convenient that the control, again derived from the knob 15, be of the swivel type, as shown schematically in FIG. 5, where the parts corresponding to those of the control in FIG. 2 are denoted with the same reference numerals. The various player figurees of each control are in this case attached spaced apart to a common yoke 25 extending transversally with respect to the parallel grooves 17. The case has been assumed of two player figures actuated concurrently, but it will appear that these may be more than two. The yoke 25 is swivel connected at 26 to a connecting rod 27, which is in turn swivel connected at 28 to the control rod 11 making part of the mechanical control means.

The swivel type of control has the advantage of allowing on one side a common design for the greatest part of the control members. In face, assuming that a single control actuates a pair of players and that the players of each pair are disposed at an equal distance D, then all the control parts, excepting the connecting rod 27, are equal, regardless of the position of the player pair on the playing field.

Figure 6:
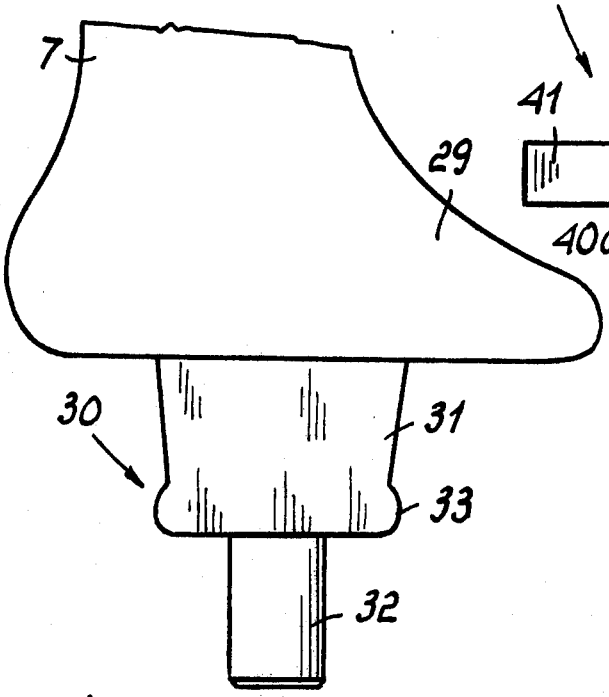
FIGS. 6 and 7 show, to a much enlarged scale, the stationary foot of the player figure and related attaching portion, respectively as an elevational view and as a front view.
Figure 8:
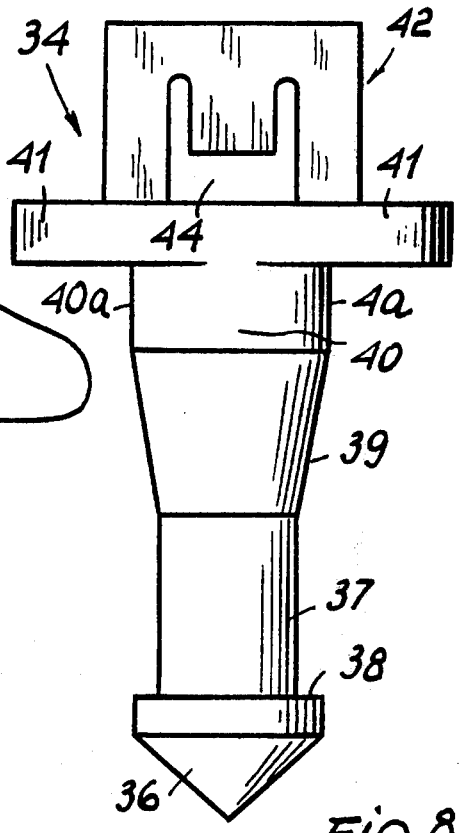
FIGS. 8 and 9 show the intermediate connecting member, respectively as a front view and top view, also to a much enlarged scale.
Figures 10, 11:
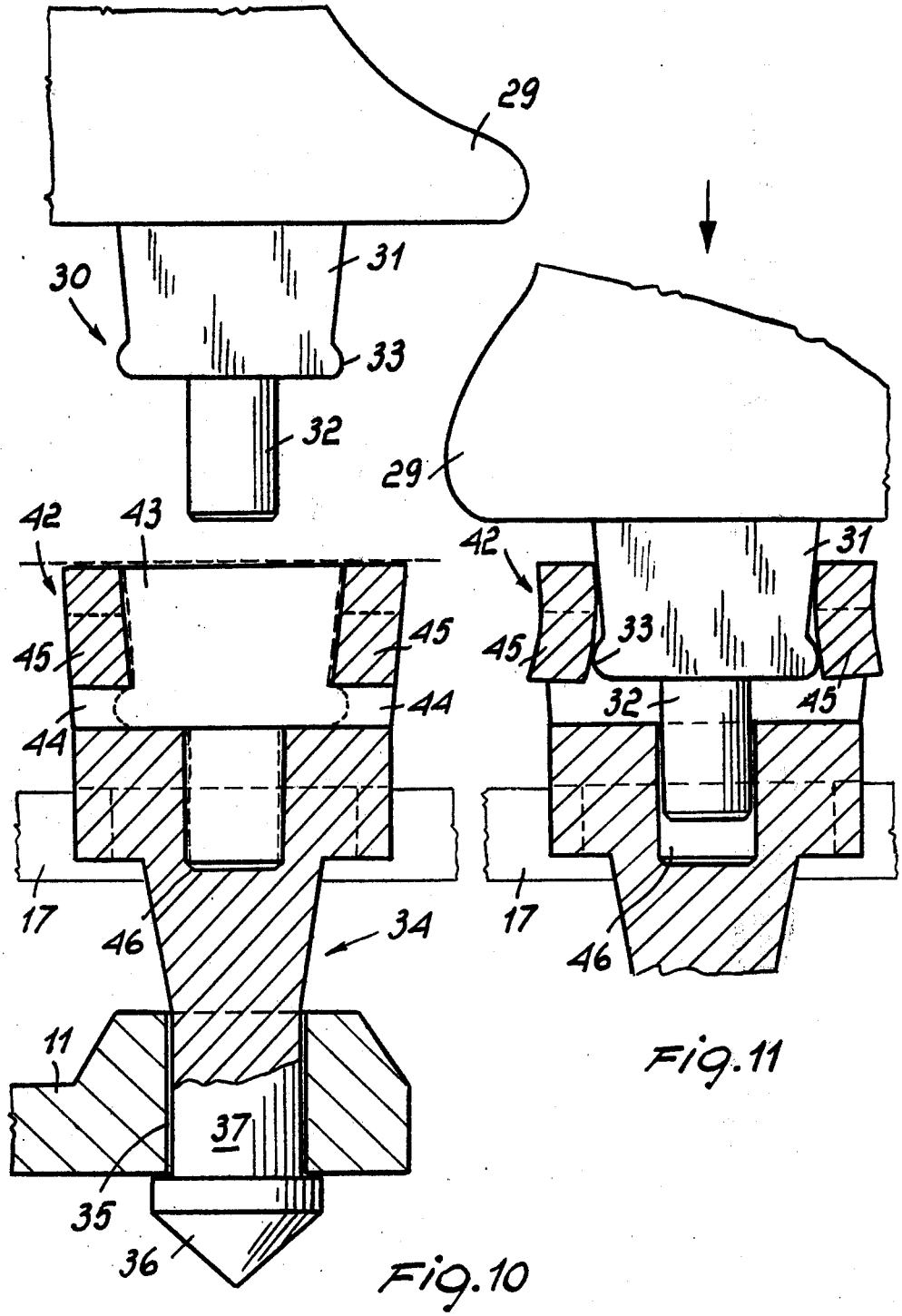
FIG. 10 shows the foot and intermediate connecting member, partially sectioned along the line X—X of FIG. 9, before the connection.
FIG. 11 shows how the snap-on insertion of the foot is effected in the intermediate connecting member.

In order to attach the player FIG. 2 to the actuating rod 11 or 25, an attaching structure may be provided as depicted in FIGS. 6 and 11.

Figure 7:
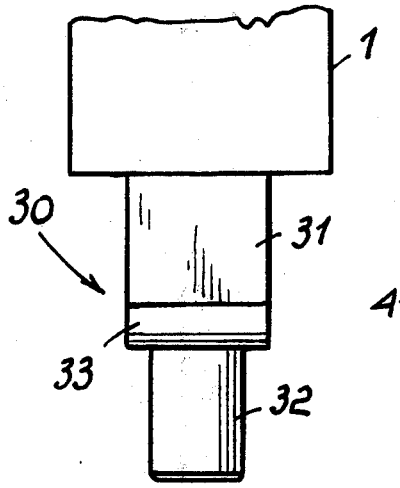
Figure 9:
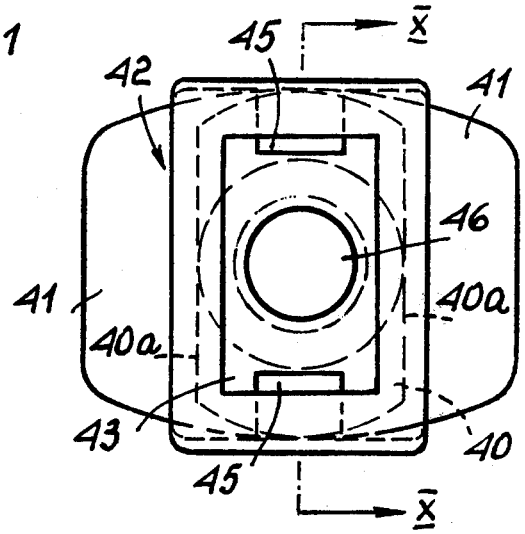

According to a specially advantageous embodiment shown in FIGS. 6 and 7, to the lower portion of the foot 29 of a player FIG. 2 and appendage 30 is rigidly mounted comprising a shaped portion 31 and an end pin 32. The shaped portion 31 has a transverse dimension greater than the pin 32, and is of preference tapered from top to bottom, terminating in an enlarged portion 33. The shaping of the portion 31 is provided, preferably, on two opposite side faces only, whereas the remaining two faces are perfectly flat, as shown in FIG. 7. The appendage 30 axis is substantially parallel to the ideal one of the stationary leg 7.

As shown in FIGS. 8 to 11, the intermediate connecting member 34, of elongated configuration comprises an upper end configurated for detachably engaging with the appendage 30, as explained hereinafter, and a lower end for fixedly engaging with one end of an actuating rod 11 formed with a through hole 35. More particularly, said lower end has a conical termination portion 36 with a base of greater dimensions than the dimensions across the lower stem 37 of the member 34 such as to define an abutment 38. The stem 37 cross section is substantially equal to that of the hole 35. The transverse dimensions of the base of the conical portion 36 are such as to allow the press insertion with elastic deformation or the conical portion 36 into the hole 35 during the assembling step, the abutment 38 preventing, moreover, the member 34 from coming out of the hole 35 and ensuring a permanent connection of the member 34 with the rod 11.

The intermediate connecting member 34 includes, moreover, a frustrum portion 39 joining the stem 37 to the portion 40, which is provided with parallel guide surfaces 40*a* over which two opposite wings 41 project having supporting and guiding functions respectively on the game field 1 plane. Such wings also prevent any axial movement of the member 34 in a downward direction, after the stem 37 has been inserted in the hole 35.

On the portion 40 of the member 34 there is formed a housing body 42 defining at the inside a housing cavity 43 effective to accomodate, in contour mating relationship, the appendage 30 of the foot 29 of the player FIG. 2, the cavity 43 and appendage 30 constituting mating engagement means.

More specifically, the body 42 has of preference a hollow and substantially rectangular prismatic shape, with two opposite side walls slightly inclined to each other from top to bottom. The thickness of the hollow body 42 is substantially uniform all around the cavity 43. In each inclined side wall a substantially U-like opening 44 is formed defining a central tab 45 directed downward and toward the cavity 43 inside. The two tabs 45 generate accordingly at their free ends, i.e., at an area spaced apart from the mouth end of the cavity 43, a restriction of said cavity, followed by a widening out defined by the opening 44. The length of the tabs 45 is such as to allow between the free ends of the tabs and the upper plane of the wings 41 a space interval which is substantially equal to the height of the enlarged portion 33 of the player foot appendage 30.

Furthermore, in the portion 40 of the member 34, a blind hole 46 is provided which is adapted to accommodate in a geometric type of coupling the end pin 32 of the appendage 30.

Most advantageously, the intermediate connecting member 34 is made of a plastic material, such as to allow a certain resiliency for the tabs, for the insertion of the appendage 30 and the attachment of the stationary leg 6 of the player FIG. 2 in the manner that will be now described with referecne to FIGS. 10 and 11.

After the member 34 has been attached to the rod 11 in the manner described above, the member 34 is accomodated in the guide window 17 of the game field 1, with its wings 41 guided on or in the game field, the surfaces 40*a* preventing the member 34 from rotating. In order to connect the player FIG. 2 with the rod 11, it is now sufficient to push the player FIG. 2 downwards so that the appendage 30 enters the cavity 43. By exerting pressure on the player figure, the widened portion 33 engages with the tabs 45, facing each other, moving resiliently outward such tabs, as shown in FIGS. 11, until the widened portion 33 positions itself in the free space underlying the tabs 45 (as shown in dotted lines in FIG. 10). Advantageously, the insertion operation is made easier by the guiding action performed by the end pin 32 during its penetration into the blind hole 46. As the insertion is completed, the bottom plane of the shaped portion 31 is perfectly in contact with the bottom plane of the cavity 43 and the player FIG. 2 is rigidly connected to the intermediate connecting member 34 thanks to the mating configurations of the cavity 43 and shaped portion 31 and to the presence of the pin 32 and blind hole 46.

Quite advantageously, the widened portion 33 is provided with rounded off surfaces which favor the withdrawal of the player figure, for example to replace it, in that they allow a mutual outward movement of the tabs 45, like in the insertion case. A pulling action on the player FIG. 2 directed upwards thus ensures a positive separation of the player figure from the intermediate connecting member 34, while it leaves said member in engagement with the rod 11 owing to the abutment 38. Therefore, it becomes possible to replace the player figure without effecting any operation under the game field 1.

Figure 12:
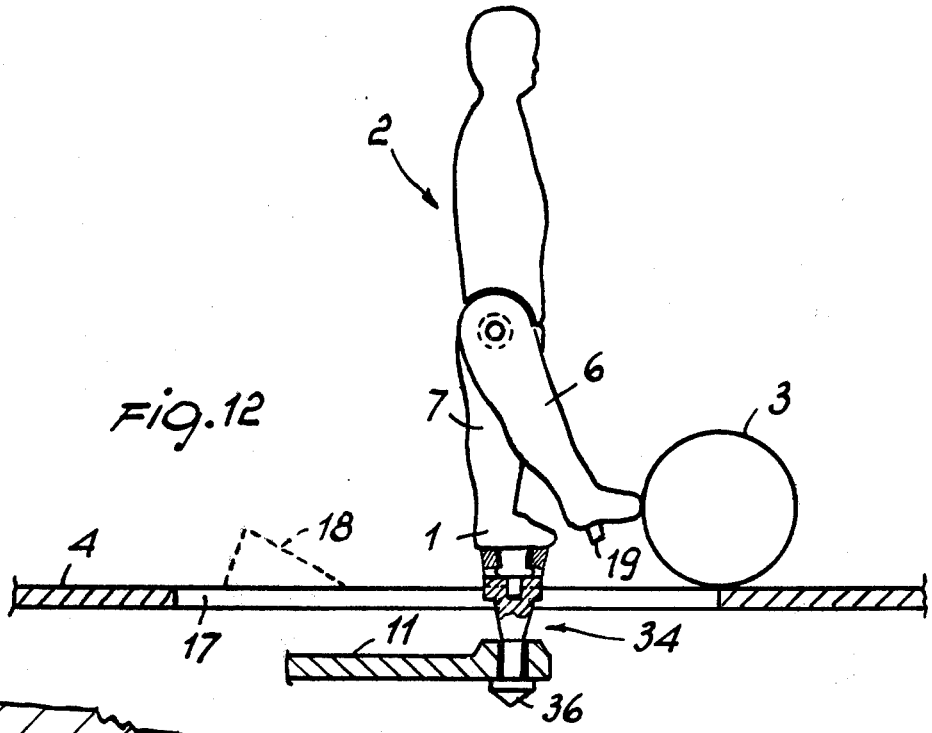
FIG. 12 shows a player figure completely assembled.

FIG. 12 shows the player-actuating rod assembly completely assembled.

Figure 13:
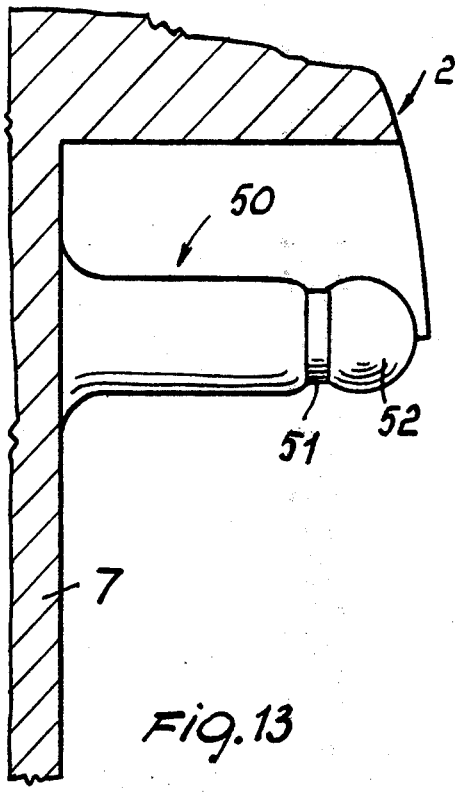
FIGS. 13 and 14 show details of the attaching structure for the movable leg to the body of the player figure.
Figure 14:
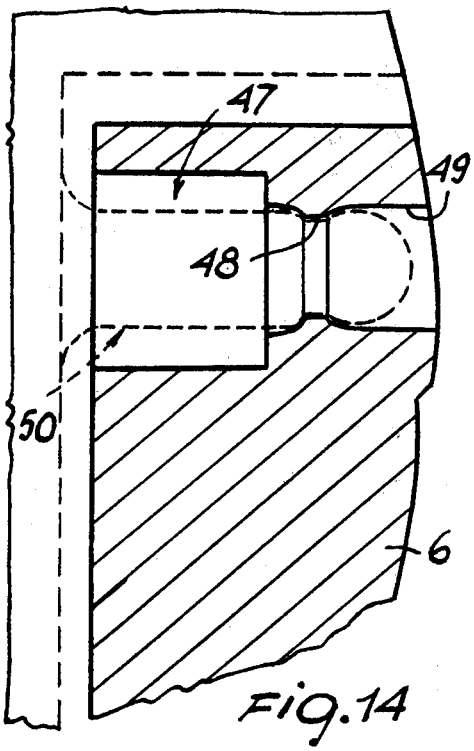

The movable leg 6 may be advantageously connected to the statioary leg 7 or the body of the player FIG. 2 by means of a connection as shown in FIGS. 13 and 14. The movable leg comprises in this instance a housing cavity 47 located on the same side as the stationary leg 7 and provided with a restricted portion 48 followed by a widened portion 49 at a position spaced apart from the cavity 47 mouth. The axis of the cavity 47 extends perpendicularly to the throwing plane.

The stationary leg 7 comprises at its top portion, at the cavity 47, a pin member 50 having a substantially cylindrical shape and provided with a restricted portion 51 and a rounded end head 52.

The movable leg 6 is press mounted, as it will be apparent from FIG. 14, by introducing the pin member 50 into the cavity 47 until the rounded head 52 passes by elastic deformation the restriction 48 and snaps into the widened portion 49 of the cavity 27. Advantageously, the transverse dimensions of the pin member 50 are slightly smaller than those of the corresponding points in the cavity 47, such as to allow a free swinging movement of the movable leg 6 about the pin member 50. The presence of the restricted portions 48 and 51 and of the widened portion 49 housing the head 52 ensures a permanent positioning of the movable leg 6 during and after the throwing action. The rounded configuration of the head 52 allows, however, the removal of the movable leg 6, for example in order to replace it, by pulling the leg parallel to the pin 50 until the head 52 moves beyond the restriction 48.

In the wider portion of the cavity 47, close to the stationary leg 7, the torque spring 9 is housed, not shown in FIG. 14.

The invention described above is susceptible to many modifications and variations, all of which fall within the scope of the present inventive concept. Thus, for example, the playing ball, in alternative to being made of a foamed plastics with nails, as exemplarly described above, may be made of a plastic material in which a cage of a ferromagnetic material is imbedded, or may be constructed by two hollow half-spheres foamed together after inserting in the cavity a ball of a ferromagnetic material having a diameter much smaller than that of the spherical cavity formed by the two half-spheres.

In order to attached the player FIG. 2, rather than providing a widened portion 33 on the shaped portion 31 of the appendage 30, a rib could be provided in the housing cavity 43 and a corresponding groove on the appendage 30. It will be apparent, morever, that it is possible to form a cavity in the foot 29 and an appendage on the intermediate connecting member 34. The pin member 50, of course could be provided on the movable leg 6 and the related housing cavity in the stationary leg 7. The tabs 45 could also be provided on all the four sides of the hollow body 42. The cross-section of the shaped portion 31 as well as of the cavity 43 could be circular rather than rectangular.

In practicing the invention, the materials employed may be any ones, even though plastc materials are specially preferred.

I claim:

1. A game playing structure, particularly a soccer game, where the ball, or similar, disposed on the surface of a playing field at a given distance from a player figure, is thrown away by the movement of the player, a movement of the person taking part in the game being transferred to the player figure through mechanical means, characterized in that to the figure a throwing portion is connected, particularly in the form of a leg, in a swingable manner against a biasing spring, that the figure is movable across the surface of the playing field through the mechanical means, that an obstacle is arranged on the surface of the playing field in the path of motion of the throwing portion, which obstacle during the figure movement initially holds back the throwing portion and rotates the same against the biasing spring and then releases it as the figure moves further, and that in the figure direction of motion at the throwing portion area during the return stroke after its release caused by the spring action the ball or similar support is located.

2. A playing structure according to claim 1, characterized in that as the support for the ball a permanent magnet is used supported by the playing field, the ball or similar being provided with iron parts.

3. A playing structure according to claim 2, characterized in that the ball is made of foamed plastics, in which nails are inserted distributed over its surface.

4. A playing structure according to claim 1, characterized in that one portion, in particular in the form of a supporting leg firmly connected to the figure is connected through a slot guide of the playing field to the transferring mechanical means which are made to project under the playing field as far as an actuating member accessible to one of the persons taking part in the game.

5. A playing structure according to claim 4, characterized in that as the transferring mechanical means a rod is used subjected to the action of a further spring, which rod is connected at one end to the figure and at the other end to a knob, the spring pushig the figure toward one end of the slot guide in the stand-by position.

6. A playing structure according to claim 1, characterized in that when the figure is in its stand-by position the obstacle is located in front of the throwing portion of the figure, that the obstacle is provided in the direction of motion with a reaction supporting surface and, contrary to the direction of motion with a sliding surface, for the abutment of the throwing portion the sliding surface cooperating with a cavity in the side edge of the slot guide.

7. A playing structure according to claim 6, characterized in that for releasing the throwing portion by the obstacle, the distance of the upper side of the reaction supporting surface and of the bottom or lower side of the abutment from the rotation axis of the throwing portion is selected such that after the rotation of the throwing portion through a predetermined angle, specifically up to the approximate final position toward the rear, the abutment is allowed to slide on the side to disengage from the obstacle through the action of the spring.

8. A playing structure according to claim 1, characterized in that in the stand-by position the throwing portion and body of the figure rest one against the other by means of locking parts under the action of the spring the throwing portion assuming with respect to the figure the stand-by position which is customary for such games.

9. A playing structure according to claim 1, characterized in that the obstacle is located at one of the side edges of the slot guide.

10. A playing structure according to claim 1, characterized in that is comprises at least two player figures which may be actuated concurrently, said player figures being movable parallel to and being affixed spaced apart from a common yoke connected to said mechanical means through a rod swivel connected respectively to said mechanical means and said yoke.

11. A playing structure according to claim 1, characterized in that in order to attach said player figure an intermediate connecting member is provided effective to be affixed at one of its ends permanently to an actuating rod of said mechanical actuating means and provided with engagement means for removably engaging correspondingly mating engagement means provided on a leg of said player figure.

12. A playing structure according to claim 11, characterized in that said intermediate connecting member is provided with a housing cavity formed at the opposite end to that attached to said actuating rod, said cavity including a restricted portion followed by a widened portion at a position spaced apart from the mouth end, and that said player figure comprises a foot provided with an appendage having a substantially mating shape to the shape of said cavity and provided with an enlarged portion snap insertable in said widened portion.

13. A playing structure according to claim 12, characterized in that said housing cavity is defined inside a hollow body having at least two opposite side walls provided each with a substantially U-like opening defining a central tab, the tabs having a free end spaced apart from the bottom plane of said cavity to an extent such as to define said widened portion.

14. A playing structure according to claim 13, characterized in that said tabs are slightly inclined toward the inside of said cavity, the lesser mutual distance being that at said widened portion.

15. A playing structure according to claim 12, characterized in that said appendage is formed with an end pin and that said housing cavity is formed with a blind hole having a mating shape to accomodate said end pin.

16. A playing structure according to claim 11, characterized in that said intermediate connecting member has an elongate shape with a stem and a conical end having a base of larger dimensions than the transverse dimensions of said stem, said conical end being press insertable by elastic deformation in a through hole in said actuating rod having transverse dimensions substantially equal to those of said stem, said base preventing said member from being withdrawn from said hole.

17. A playing structure according to claim 11, characterized in that said intermediate connecting member is provided with two guide wings for guidingly engaging with the playing field.

18. A playing structure according to claim 11, characterized in that in the upper part of one of the legs of the player figure on the side facing the other leg a housing cavity is formed which extends perpendicularly to the throwing plane, said cavity being provided with a restricted portion followed by a widened portion at a position spaced apart from the mouth of said housing cavity and that on the upper part of said other leg at said housing cavity a pin member is provided including a rounded head having dimensions substantially greater than those of said restricted portion, said head being removably insertable by pressure in said widened portion beyond said restricted portion, the transverse dimensions of said pin member being slightly smaller than those of the corresponding parts of said housing cavity in order to allow the free rotation of the movable leg with respect to the stationary leg.

19. A playing structure according to claim 18, characterized in that said pin member is rigid with said player figure and that said housing cavity is provided in said movable leg.

* * * * *